US006340071B1

(12) United States Patent
Diekemper

(10) Patent No.: US 6,340,071 B1
(45) Date of Patent: Jan. 22, 2002

(54) RUNG-FOLDABLE LADDER DEVICE

(76) Inventor: Gerhard M. Diekemper, 20400 Walcott Rd., Carlyle, IL (US) 62231

( * ) Notice: Subject to any disclaimer, the term of this patent is extended or adjusted under 35 U.S.C. 154(b) by 0 days.

(21) Appl. No.: 09/844,325

(22) Filed: Apr. 27, 2001

(51) Int. Cl.[7] ..... E04G 3/00; A62B 1/20
(52) U.S. Cl. ..... 182/100; 182/189
(58) Field of Search ..... 182/93, 100, 189, 182/107, 214; 114/90

(56) References Cited

U.S. PATENT DOCUMENTS 3,019,851 A * 2/1962 Doss ..... 182/100
3,995,714 A 12/1976 Brookes et al.
4,132,288 A 1/1979 Bingham
4,981,195 A * 1/1991 Merrick ..... 182/100
5,040,635 A 8/1991 Strickland
5,109,954 A 5/1992 Skyba
5,113,782 A * 5/1992 Mc Carty ..... 182/93 X
5,150,766 A * 9/1992 Bell ..... 182/100
5,253,732 A * 10/1993 Daniels ..... 182/100 X
5,388,664 A * 2/1995 Bator ..... 182/100
5,454,445 A * 10/1995 Berryman ..... 182/100 X
5,655,623 A * 8/1997 Skyba ..... 182/100 X
5,816,362 A 10/1998 Jenkins, Jr.
D417,011 S 11/1999 Woller, Sr. et al.
6,076,634 A * 6/2000 Simon ..... 182/100
6,138,792 A * 10/2000 Morris ..... 182/93

* cited by examiner

*Primary Examiner*—Daniel P. Stodola
*Assistant Examiner*—Hugh B. Thompson

(57) ABSTRACT

A rung-foldable ladder device for attaching to an upright structure for climbing thereupon. The rung-foldable ladder device includes an elongate tubular support member; and also includes a plurality of bracket members being securely attached to the elongate tubular support member and being adapted to removably fasten with straps about an upright structure; and further includes a plurality of rung members being pivotally attached to the elongate tubular support member; and also includes a cable being attached to the rung members for pivoting the rung members against the elongate tubular support member.

6 Claims, 3 Drawing Sheets

RUNG-FOLDABLE LADDER DEVICE

BACKGROUND OF THE INVENTION

1. Field of the Invention

The present invention relates to stackable ladders and more particularly pertains to a new rung-foldable ladder device for attaching to an upright structure for climbing thereupon.

2. Description of the Prior Art

The use of stackable ladders is known in the prior art. More specifically, stackable ladders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,040,635; U.S. Pat. No. 3,995,714; U.S. Pat. No. 4,132,288; U.S. Pat. No. 5,816,362; U.S. Pat. No. Des. 417,011; and U.S. Pat. No. 5,109,954.

While these devices fulfill their respective, particular objectives and requirements, the aforementioned patents do not disclose a new rung-foldable ladder device. The inventive device includes an elongate tubular support member; and also includes a plurality of bracket members being securely attached to the elongate tubular support member and being adapted to removably fasten with straps about an upright structure; and further includes a plurality of rung members being pivotally attached to the elongate tubular support member; and also includes a cable being attached to said rung members for pivoting said rung members against said elongate tubular support member.

In these respects, the rung-foldable ladder device according to the present invention substantially departs from the conventional concepts and designs of the prior art, and in so doing provides an apparatus primarily developed for the purpose of attaching to an upright structure for climbing thereupon.

SUMMARY OF THE INVENTION

In view of the foregoing disadvantages inherent in the known types of stackable ladders now present in the prior art, the present invention provides a new rung-foldable ladder device construction wherein the same can be utilized for attaching to an upright structure for climbing thereupon.

The general purpose of the present invention, which will be described subsequently in greater detail, is to provide a new rung-foldable ladder device which has many of the advantages of the stackable ladders mentioned heretofore and many novel features that result in a new rung-foldable ladder device which is not anticipated, rendered obvious, suggested, or even implied by any of the prior art stackable ladders, either alone or in any combination thereof.

To attain this, the present invention generally comprises an elongate tubular support member; and also includes a plurality of bracket members being securely attached to the elongate tubular support member and being adapted to removably fasten with straps about an upright structure; and further includes a plurality of rung members being pivotally attached to the elongate tubular support member; and also includes a cable being attached to said rung members for pivoting said rung members against said elongate tubular support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new rung-foldable ladder device which has many of the advantages of the stackable ladders mentioned heretofore and many novel features that result in a new rung-foldable ladder device which is not anticipated, rendered obvious, suggested, or even implied by any of the prior art stackable ladders, either alone or in any combination thereof.

It is another object of the present invention to provide a new rung-foldable ladder device which may be easily and efficiently manufactured and marketed.

It is a further object of the present invention to provide a new rung-foldable ladder device which is of a durable and reliable construction.

An even further object of the present invention is to provide a new rung-foldable ladder device which is susceptible of a low cost of manufacture with regard to both materials and labor, and which accordingly is then susceptible of low prices of sale to the consuming public, thereby making such rung-foldable ladder device economically available to the buying public.

Still yet another object of the present invention is to provide a new rung-foldable ladder device which provides in the apparatuses and methods of the prior art some of the advantages thereof, while simultaneously overcoming some of the disadvantages normally associated therewith.

Still another object of the present invention is to provide a new rung-foldable ladder device for attaching to an upright structure for climbing thereupon.

Yet another object of the present invention is to provide a new rung-foldable ladder device which includes an elongate tubular support member; and also includes a plurality of bracket members being securely attached to the elongate tubular support member and being adapted to removably fasten with straps about an upright structure; and further includes a plurality of rung members being pivotally attached to the elongate tubular support member; and also includes a cable being attached to said rung members for pivoting said rung members against said elongate tubular support member.

Still yet another object of the present invention is to provide a new rung-foldable ladder device that is easy and convenient to use.

Even still another object of the present invention is to provide a new rung-foldable ladder device that can be easily and quickly set up and taken down with the rung members being folded against the elongate tubular support member for easy and compact storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
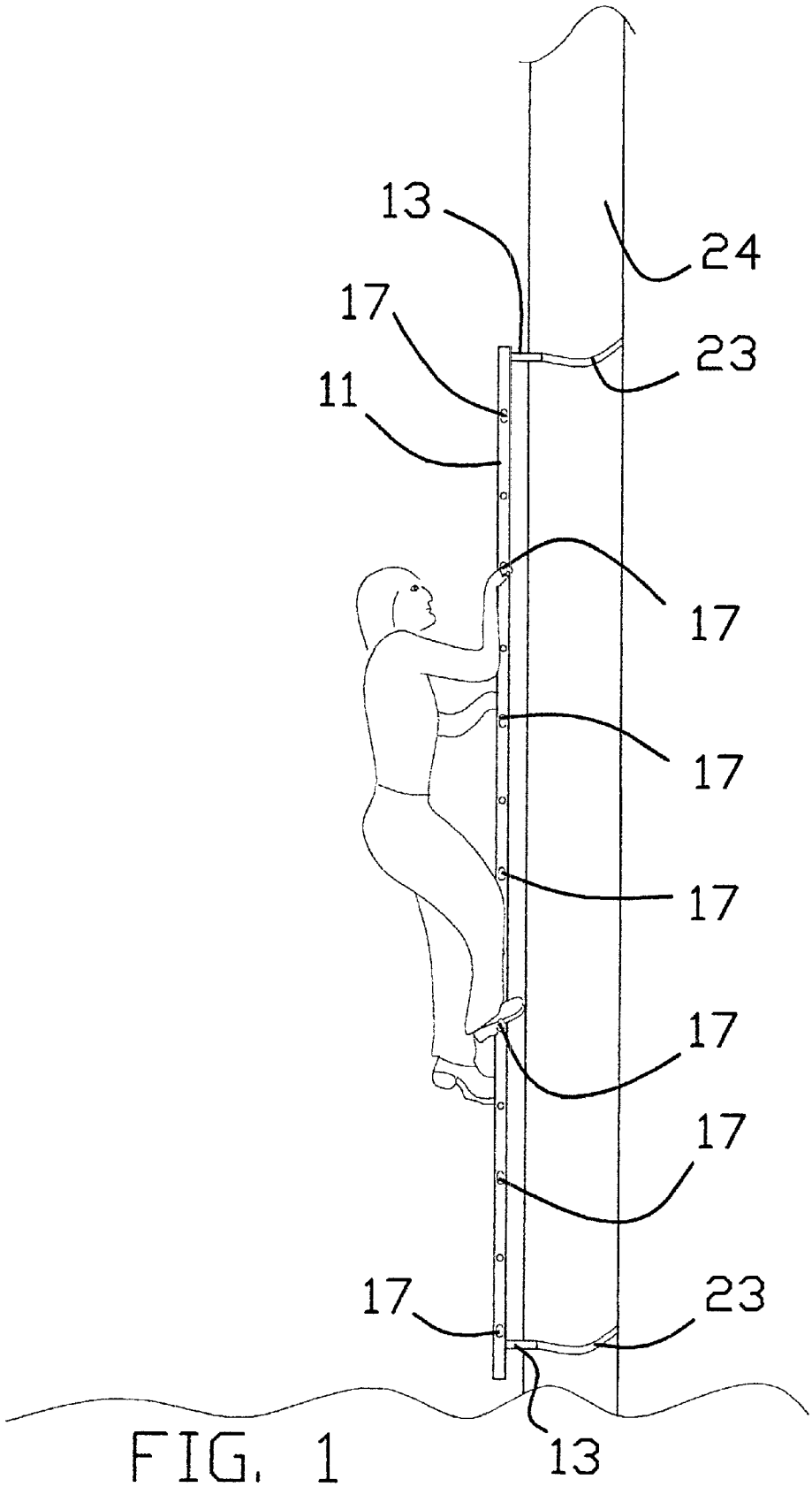
FIG. 1 is a side elevational view of a new rung-foldable ladder device according to the present invention and shown in use.
Figure 2:
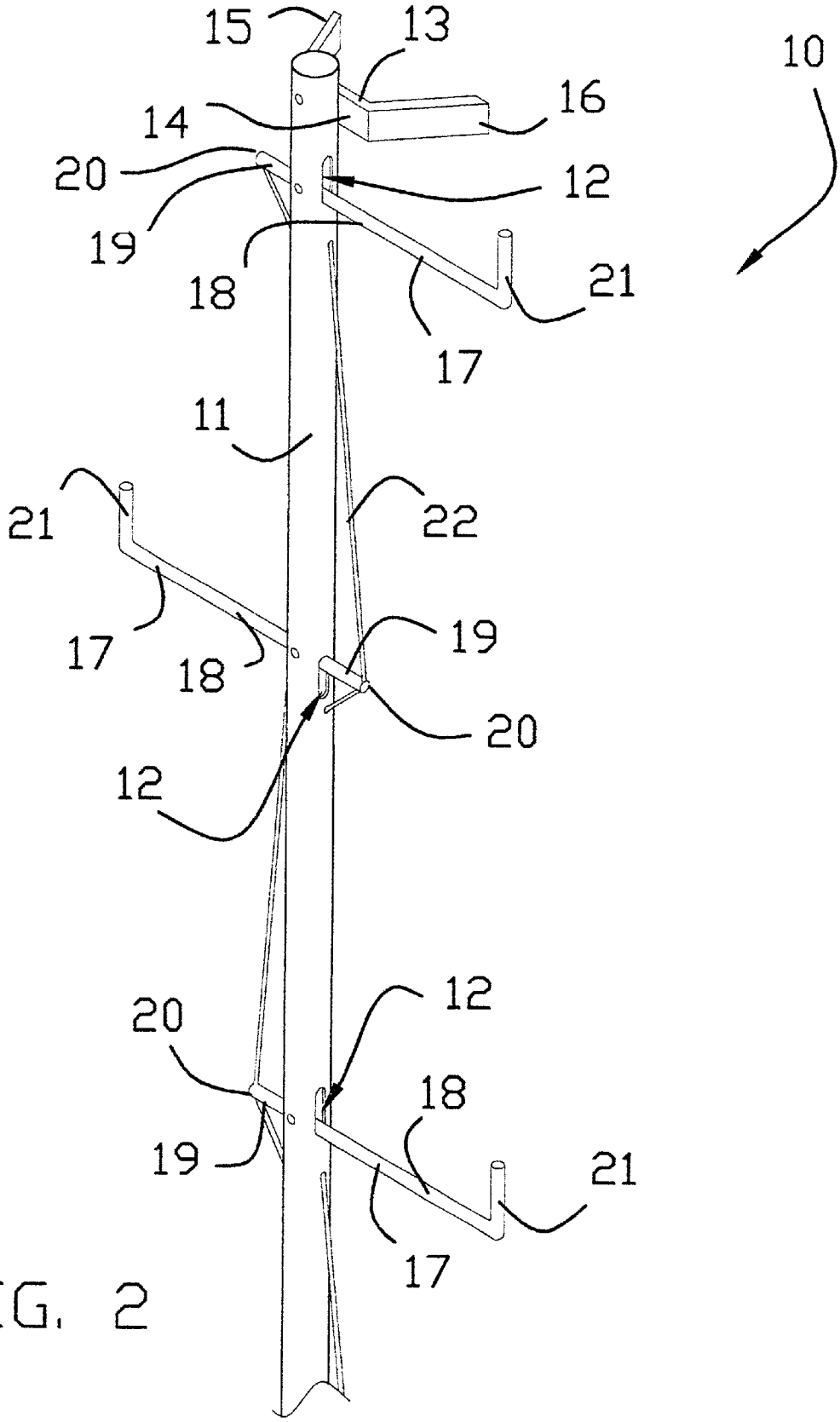
FIG. 2 is a perspective view of the present invention.
Figure 3:
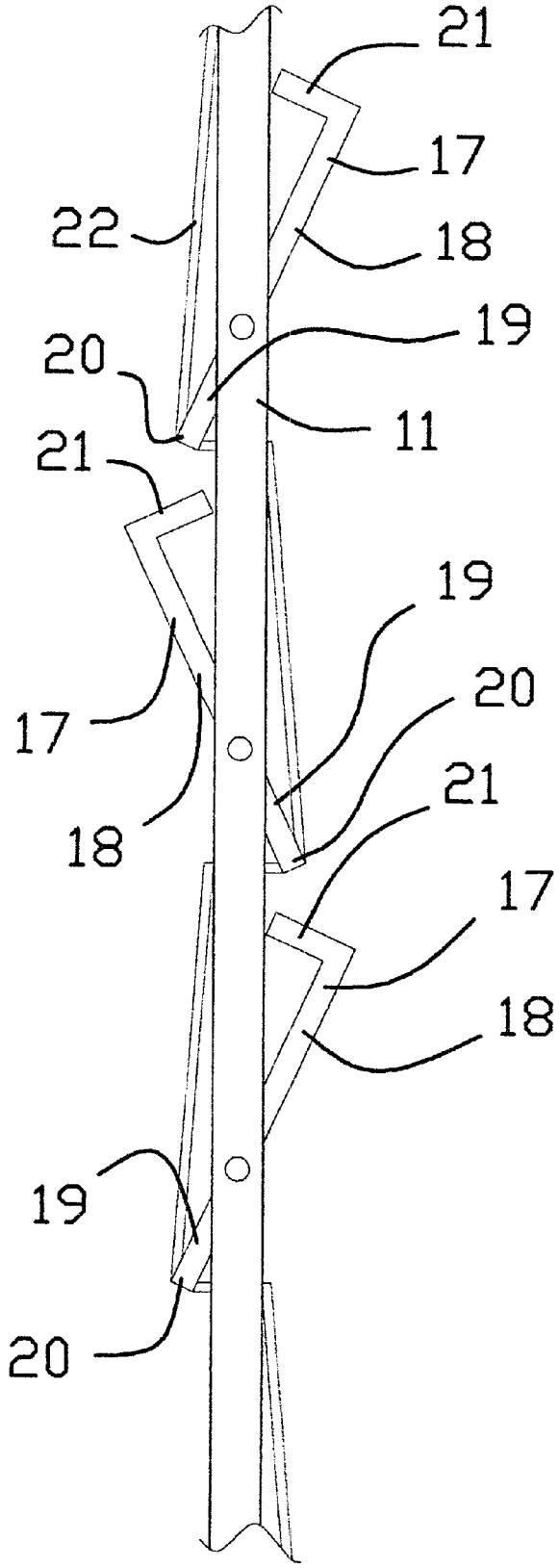
FIG. 3 is another side elevational view of the present invention.

With reference now to the drawings, and in particular to FIGS. 1 through 3 thereof, a new rung-foldable ladder device embodying the principles and concepts of the present invention and generally designated by the reference numeral 10 will be described.

As best illustrated in FIGS. 1 through 3, the rung-foldable ladder device 10 generally comprises an elongate tubular support member 11. The elongate tubular support member 11 includes a plurality of openings 12 being spaced therealong and being disposed therethrough with the elongate tubular support member 11 having a length of approximately 64 inches. A plurality of bracket members 13 are securely and conventionally attached to the elongate tubular support member 11 and are adapted to removably fasten with straps 23 about an upright structure 24. Each of the bracket members 13 includes an elongate main portion 14 being fastened to the elongate tubular support member 11, and also includes a pair of elongate end portions 15, 16 being angled relative to the main portion 14 and to one another. The elongate end portions 15, 16 are adapted to fit about the upright structure 24.

A plurality of rung members 17 are pivotally and conventionally attached to the elongate tubular support member 11. Each of the rung members 17 includes an elongate shaft portion 18 having a first end portion 19 being disposed through a respective opening 12, and also includes a second end portion 21 being angled relative to the elongate shaft portion 18. The elongate shaft portion 18 is hingedly attached in the elongate tubular support member 11. A cable 22 is conventionally attached to the rung members 17 for pivoting the rung members 17 against the elongate tubular support member 11. The cable 22 interconnects first ends 20 of the elongate shaft portions 18 and being movably disposed through the elongate tubular support member 11 for pivoting the rung members 17.

In use, the users places the elongate tubular support member 11 up against an upright structure 24 such as a tree and fastens the elongate tubular support member 11 to the upright structure 24 using the straps 23, and the user pivots the rung members 17 using the cable 22 so that the rung members 17 are generally disposed perpendicular to the elongate tubular support member 11 to allow the user to climb upon the upright structure 24. If needed, the user can stack other rung-foldable ladder devices 10 upon one another.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rung-foldable ladder device comprising:

an elongate tubular support member;

a plurality of bracket members being securely attached to said elongate tubular support member and being adapted to removably fasten with straps about an upright structure;

a plurality of rung members being pivotally attached to said elongate tubular support member; and a cable being attached to said plurality of rung members for pivoting said rung members against said elongate tubular support member.

2. A rung-foldable ladder device as described in claim 1, wherein said elongate tubular support member includes a plurality of openings being spaced therealong and being disposed therethrough.

3. A rung-foldable ladder device as described in claim 2, wherein each of said rung members includes an elongate shaft portion having a first end portion being disposed through a respective one of said openings, and also includes a second end portion being angled relative to said elongate shaft portion, said elongate shaft portion being hingedly attached in said elongate tubular support member.

4. A rung-foldable ladder device as described in claim 3, wherein said cable interconnects said first end portions of said elongate shaft portions and is movably disposed through said elongate tubular support member for pivoting said rung members.

5. A rung-foldable ladder device as described in claim 1, wherein each of said bracket members includes an elongate main portion being fastened to said elongate tubular support member and also includes a pair of elongate end portions being angled relative to said main portion and to one another, said elongate end portions being adapted to fit about the upright structure.

6. A rung-foldable ladder device comprising:

an elongate tubular support member, said elongate tubular support member including a plurality of openings being spaced therealong and being disposed therethrough, said elongate tubular support member having a length of approximately 64 inches;

a plurality of bracket members being securely attached to said elongate tubular support member and being adapted to removably fasten with straps about an upright structure, each of said bracket members including an elongate main portion being fastened to said elongate tubular support member and also including a pair of elongate end portions being angled relative to said main portion and to one another, said elongate end portions being adapted to fit about the upright structure;

a plurality of rung members being pivotally attached to said elongate tubular support member, each of said rung members including an elongate shaft portion having a first end portion being disposed through a respective one of said openings, and also including a second end portion being angled relative to said elongate shaft portion, said elongate shaft portion being hingedly attached in said elongate tubular support member; and a cable being attached to plurality of said plurality of rung members for pivoting said rung members against said elongate tubular support member, said cable interconnecting said first end portions of said elongate shaft portions and being movably disposed through said elongate tubular support member for pivoting said rung members.

* * * * *